US012138678B2

(12) United States Patent
Millioto

(10) Patent No.: US 12,138,678 B2
(45) Date of Patent: Nov. 12, 2024

(54) TAILOR HARDENING OF SUCH AS A COLD STAMPED VEHICLE DOOR PILLAR USING ADVANCED HIGH STRENGTH STEEL TO EXHIBIT EACH OF HARD, TRANSITION AND SOFT ZONES

(71) Applicant: Martinrea International US Inc., Auburn Hills, MI (US)

(72) Inventor: Vincent Millioto, Macomb, MI (US)

(73) Assignee: MARTINREA INTERNATIONAL US INC., Auburn Hills, MI (US)

( * ) Notice: Subject to any disclaimer, the term of this patent is extended or adjusted under 35 U.S.C. 154(b) by 0 days.

(21) Appl. No.: 18/382,624

(22) Filed: Oct. 23, 2023

(65) Prior Publication Data

US 2024/0131574 A1 Apr. 25, 2024
US 2024/0226992 A9 Jul. 11, 2024

Related U.S. Application Data

(60) Provisional application No. 63/418,673, filed on Oct. 24, 2022.

(51) Int. Cl.
*B21D 22/02* (2006.01)
*B21D 53/88* (2006.01)

(52) U.S. Cl.
CPC ..... *B21D 53/88* (2013.01); *B21D 22/022* (2013.01)

(58) Field of Classification Search
CPC ..... C21D 1/673; C21D 1/34; C21D 8/0205; C21D 2221/00; B21D 22/208; B21D 37/16; B21D 53/88; B21D 22/022
See application file for complete search history.

(56) References Cited

U.S. PATENT DOCUMENTS 7,025,409 B2 4/2006 Riley et al.
7,396,072 B2 7/2008 Fischer et al.
(Continued)

FOREIGN PATENT DOCUMENTS

CN 113 976 683 A 1/2022
FR 3090555 A1 6/2020
(Continued)

OTHER PUBLICATIONS

International Search Report and Written Opinion for Appln. No. PCT/US2023/077610 mailed on Feb. 9, 2024, 13 pages.

*Primary Examiner* — Lee A Holly
(74) *Attorney, Agent, or Firm* — Dinsmore & Shohl LLP

(57) ABSTRACT

A process and assembly for heat treating portions of a steel article, such as an advanced high strength (AHSS) steel or Gen3 steel, in order to create each of hard and transition zones in a nominally hard steel stamping, such as in a vehicle's structural stampings including a pillar, in order to design deformation zones during a collision event. In an initial operation, the invention provides for positioning of heating elements at locations along such as a blank shaped steel article. Following an initial heating, a suitable forming or stamping operation is employed to bend or reform the article with the heated zones defining the bend axles or points within the article. Following the initial heating and bending/stamping operations, additional heating elements can be positioned, such as against outer flange locations of the previously stamped article, following which a subsequent trimming or final fabricating step is employed to complete the article.

2 Claims, 5 Drawing Sheets

(56) References Cited

U.S. PATENT DOCUMENTS

| | | | | |
|---|---|---|---|---|
| 9,102,357 | B2 | 8/2015 | Watanabe et al. | |
| 9,744,997 | B2 | 8/2017 | Olofsson et al. | |
| 9,884,653 | B2 | 2/2018 | Shimizu | |
| 10,272,948 | B2 | 4/2019 | Baccouche et al. | |
| 10,464,611 | B2 | 11/2019 | Piper et al. | |
| 10,556,624 | B2 | 2/2020 | Sohmshetty et al. | |
| 10,647,359 | B2 | 5/2020 | Maux | |
| 10,906,586 | B2 | 2/2021 | Haga et al. | |
| 10,981,602 | B2 | 4/2021 | Goldyn et al. | |
| 11,141,769 | B2 | 10/2021 | Sohmshetty et al. | |
| 11,643,146 | B2 | 5/2023 | Bodin et al. | |
| 2010/0086803 | A1 | 4/2010 | Patberg | |
| 2012/0023748 | A1 | 2/2012 | Pohl et al. | |
| 2012/0060982 | A1 | 3/2012 | Bohner et al. | |
| 2013/0105046 | A1 | 5/2013 | Carlson et al. | |
| 2017/0182918 | A1 | 6/2017 | Harris et al. | |
| 2017/0298462 | A1 | 10/2017 | Winfree et al. | |
| 2018/0274052 | A1 | 9/2018 | Chiriac et al. | |
| 2018/0363079 | A1 | 12/2018 | Wilden et al. | |
| 2019/0106155 | A1 * | 4/2019 | Singh | C21D 1/673 |
| 2019/0119768 | A1 * | 4/2019 | Schleichert | C21D 8/0205 |
| 2019/0126337 | A1 | 5/2019 | Huang et al. | |
| 2019/0345575 | A1 | 11/2019 | Fröhlich et al. | |
| 2020/0173519 | A1 | 6/2020 | S. | |
| 2020/0190611 | A1 | 6/2020 | Lu et al. | |
| 2023/0183828 | A1 | 6/2023 | Skszek | |

FOREIGN PATENT DOCUMENTS

| | | | | |
|---|---|---|---|---|
| KR | 10 2015 0090343 | A | 8/2015 | |
| WO | 2007/017579 | A1 | 2/2007 | |
| WO | 2012156084 | A1 | 11/2012 | |
| WO | 2014017961 | A1 | 1/2014 | |
| WO | 2016046637 | A1 | 3/2016 | |
| WO | WO-2021102573 | A1 * | 6/2021 | B21D 22/022 |

* cited by examiner

| Measured Location | Heated | | | Un-Heated | | |
|---|---|---|---|---|---|---|
| | Mean Diagonal Length (d) (μm) | Force(P) (gF) | Vickers Hardness (HK) | Mean Diagonal Length (d) (μm) | Force(P) (gF) | Vickers Hardness (HK) |
| 1A | 50.1 | 500 | 369 | 55.2 | 500 | 304 |
| 1B | 49.7 | 500 | 375 | 54.9 | 500 | 308 |
| 1C | 49.1 | 500 | 385 | 55.1 | 500 | 305 |
| 2A | 50.5 | 500 | 364 | 54.5 | 500 | 312 |
| 2B | 50.9 | 500 | 358 | 55.1 | 500 | 305 |
| 2C | 49.9 | 500 | 372 | 54.7 | 500 | 310 |
| 3A | 49.6 | 500 | 377 | | | |
| 3B | 49.4 | 500 | 380 | | | |
| 3C | 49.3 | 500 | 381 | | | |
| Sample Average | | | 374 | | | 307 |

FIG. 9

TAILOR HARDENING OF SUCH AS A COLD STAMPED VEHICLE DOOR PILLAR USING ADVANCED HIGH STRENGTH STEEL TO EXHIBIT EACH OF HARD, TRANSITION AND SOFT ZONES

CROSS REFERENCE TO RELATED APPLICATIONS

The present application claims the priority of U.S. Ser. No. 63/418,673 filed Oct. 24, 2022.

FIELD OF THE INVENTION

The present invention relates generally to locally enhancing the material properties of a steel stamping. More specifically, the present invention teaches a process and assembly for creating each of transition and hard zones in a steel stamping, such as in particular for use as a vehicle pillar, in order to design deformation zones during a collision event.

BACKGROUND OF THE INVENTION

Advanced High Strength Steels (AHSS), also known as Gen3 steels, are known in the relevant art which allow the down gaging, and there for lightweighting, of automotive panels that take advantage of that material's higher strength.

During a crash event, energy needs to be both absorbed and transferred strategically to ensure occupant safety. The highest strength materials are sought out to accomplish that task. The risk of picking the highest strength material is that it simply allows the load to be transferred and not absorbed. Some of that energy, typically associated with a collision event, can be transferred to the occupant causing undue harm.

In an effort to have some of the energy absorbed by the body structure each of base, transition and hard zones are designed into the steel pillar so as to allow the controlled crumpling of the structure, thereby optimizing the energy both absorbed and transferred.

The state of the art technology for energy absorbing Body-In-White detail panels and subsiquent sub-assemblies has revolved around tailored material properties in Press Hardenable Stampings (PHS). For example, in a side crash the BPlr Outer Panel must first be strong enough to keep the crumple-zone intact for survivability of the occupant. Additionally, deformation or yield areas designed into the steel pillar must do so in predictable areas and at predetermined levels of force.

This often leads to the use of a tailored properties associated with press hardened steel (PHS) parts, it's use owing to it's strength, and tailored soft zones to engineer the kinematics associated with the collision event.

As is also known, press hardening is an expensive process. However, OEM's have paid the premium for such panels because of the performance they offer. The next generations steel (again AHSS or Gen3 steels) offers similar levels of strength and, with the addition of tailored Hard Zones, along with levels of tune-ability not seen in traditionally cold stamped panels.

Other prior art references include, U.S. Pat. No. 9,884,653 which is representative of the existing art and teaches a B pillar for a motor vehicle produced as a hot-stamped and press-hardened component composed of a hardenable steel alloy, wherein a lower length section extends over less than 40% of the length (L) of the B pillar in a longitudinal direction and at least regionally has different strength values in relation to an upper length section, which B pillar is, in the lower length section, in at least one cross section, mutually different strengths are formed, and in the lower length section, a soft material structure is formed regionally.

U.S. Pat. No. 7,396,072 teaches a side panel for a vehicle including, in relevant part, providing a sheet metal blank made of high strength steel, hardening at least one region of the sheet metal blank, and pressing in a single step the sheet metal blank to form a single-piece structure of sill member and roof panel portion with interconnecting pillars. The sheet metal blank can thus be formed and heat treated in a single operating cycle whereby those regions that are most likely subject to high loads are hardened.

U.S. Pat. No. 11,141,769 (Ford Global) teaches a method and apparatus for die forming a part having varied strength zones and including upper and lower die elements (tools) along with actuators and a controller which is programmed, as based on a treatment schedule, to activate and operate the actuators based on separate pressure commands corresponding to the first and second set to contact and compress the portions, and to direct a coolant distributor to deliver coolant to the coolant channel to influence austenitization and pressure applications for microstructure formation, this in order to configure the heating of the part in order to establish different strength zones.

U.S. Pat. No. 10,981,602 (BMW) which teaches a press-hardened shaped metal sheet, such as a pillar reinforcement, having at least two adjacent zones having different sheet thicknesses and different strengths such that one of the zones is press-hardened and the other zone is non-hardened or only slightly hardened. A transition zone, which is simultaneously designed as a thickness transition zone and as a strength transition zone, is located between the zones.

SUMMARY OF THE INVENTION

The present invention discloses a process and assembly for having nominal material properties and creating each of hard and transition zones in a steel stamping, such as in particular for use as a vehicle pillar, in order to design deformation zones during a collision event. In an initial operation, the invention provides for positioning of heating elements at locations along such as a blank shaped steel article. Following an initial heating, a suitable forming or stamping operation is employed to bend or reform the article with the heated zones defining the bend axles or points within the article. Following the initial heating and bending/stamping operations, the heating elements can optionally be repositioned, or ideally added, such as against outer flange locations of the previously stamped article, following which a secondary fabricating step is employed to complete the article.

The present process and assembly further provides a more efficient way of creating each of hard and transition zones in a material having a base or nominal hardness in order to optimize the deformation aspects of the steel pillar to protect the vehicle occupants during a collision event.

BRIEF DESCRIPTION OF THE DRAWINGS

Reference will now be made to the attached drawings, when read in combination with the following detailed description, wherein like reference numerals refer to like parts throughout the several views, and in which:

FIG. 9 presents a tabular presentation of each of mean diagonal length, force and hardness (measured in Vickers hardness) comparing the increase in measured quality of both un-heated and heated samples, the sample hardness averaging for a heated sample of 374 HK, as compared to 307 HK for the unheated sample.

DETAILED DESCRIPTION OF THE PREFERRED EMBODIMENTS

With reference to the attached illustrations, the present invention discloses a process and assembly for heat treating portions of a steel article, such as in particular any type of Gen3 or advanced high strength steels, in order to create each of hard and transition zones in a steel stamping with a nominal base hardness, such as in particular for use as a vehicle pillar, in order to design deformation zones during a collision event.

As will be further described in reference to the attached illustrations, the present invention envisions the strategic application of thermal energy, such as in the placement of heating elements, in order to pre-heat locations of the steel blank (typically a flattened AHSS sheet) prior to a stamping operation, as well as subsequent targeted heating steps associated with any downstream trimming or bending operation for producing a finished part, which can be achieved closer to a desired shape than is often otherwise attainable. The present process and assembly also allows for reduced application force in the stamping and finished fabrication steps.

Figure 1A:
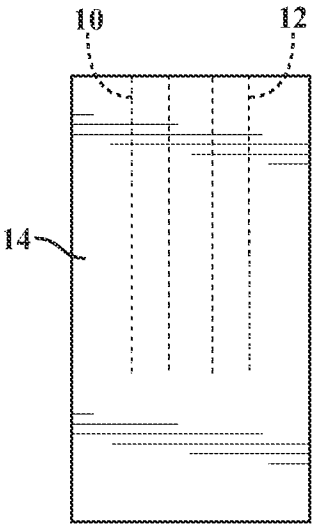
FIGS. 1A and 1B depict top and end views of an arrangement of heating elements positioned at specific locations underneath a steel sheet prior to a stamping operation.

With reference to FIGS. 1A and 1*i*, depicted are top and end views of an arrangement of heating elements, see at 10 and 12 positioned at specific locations underneath a steel sheet or blank 14, prior to a stamping operation. The heating elements can be of any known type or construction and can include, without limitation, any of direct heating or other inductive heating elements for introducing a current to flow in a material by exposing it to an alternating magnetic field. As is further known, the alternating magnetic field is typically in the kHz range and is created using a resonating coil, resulting in heat being generated through resistance losses, as well as hysteresis losses in ferromagnetic materials like iron.

Figure 1B:
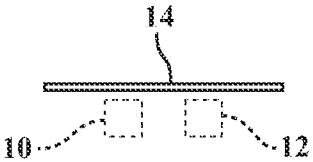
Figure 2A:
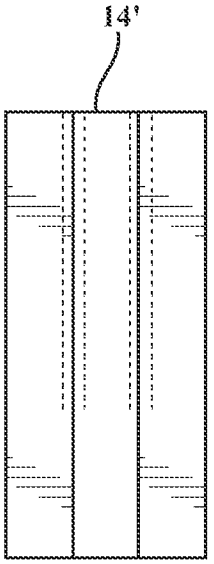
FIGS. 2A and 2B depict top and end views of edge heated zones resulting from the placement of the elements in FIGS. 1A and 1B associated with the post-stamped sheet.
Figure 2B:
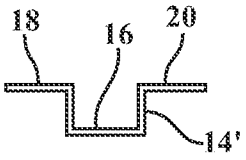

Upon the selected areas of the steel blank being heated, a typical stamping operation (not shown) is employed in order to bend or reform the blank into a three dimensional cross sectional shape 14' depicted in FIGS. 2A and 2B (including each of a base surface 16 and outer angled flange surfaces 18/20) as each of top and end views of the post-stamped sheet. The bend locations associated with the stamping process align with the edge heated zones resulting from the placement of the elements 10 and 12 in FIGS. 1A and 1B associated with the post-stamped sheet.

Figure 3A:
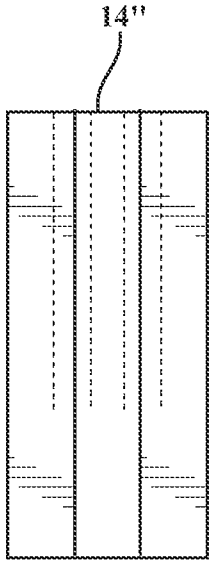
FIGS. 3A and 3B depict a further succeeding arrangement of heating elements arranged along opposite flange edges of the stamped sheet of FIGS. 2A and 2B during a secondary targeted heating and forming operation.
Figure 3B:
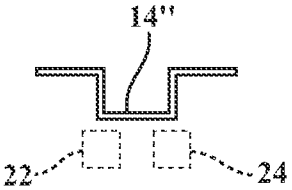

Proceeding to FIGS. 3A and 3B, depicted are a further succeeding arrangement of heating elements, which can include repositioning the original heating elements or (more typically) positioning additional heating elements at 22 and 24 along opposite flange edges of the stamped sheet (these defining additional heating zones) and in order to execute a succeeding or second heating operation following the stamping of the steel sheet or blank in order to further fabricate the previously stamped or formed blank as further shown at 14".

Figure 4:
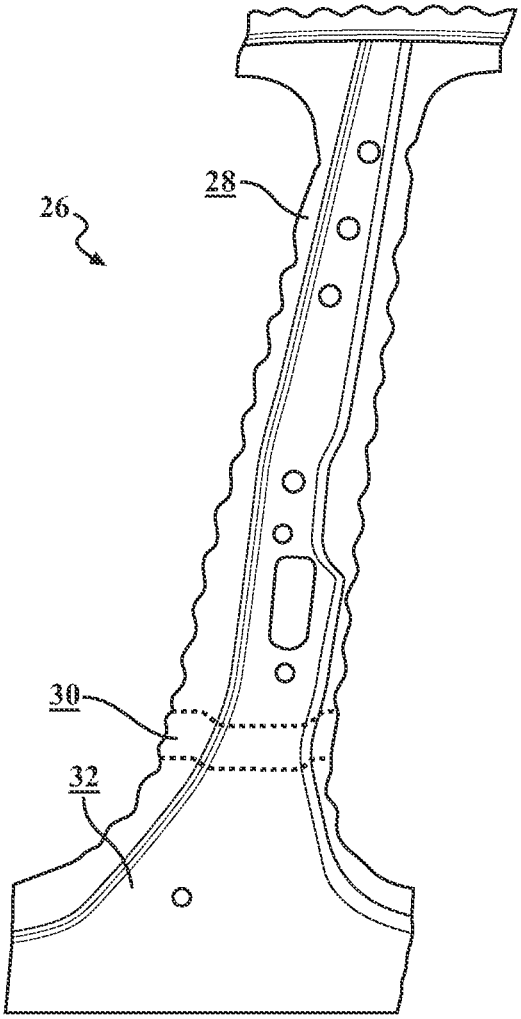
FIG. 4 is an illustration of a press hardened vehicle pillar incorporating each of hard, transition and soft zones.
Figure 5:
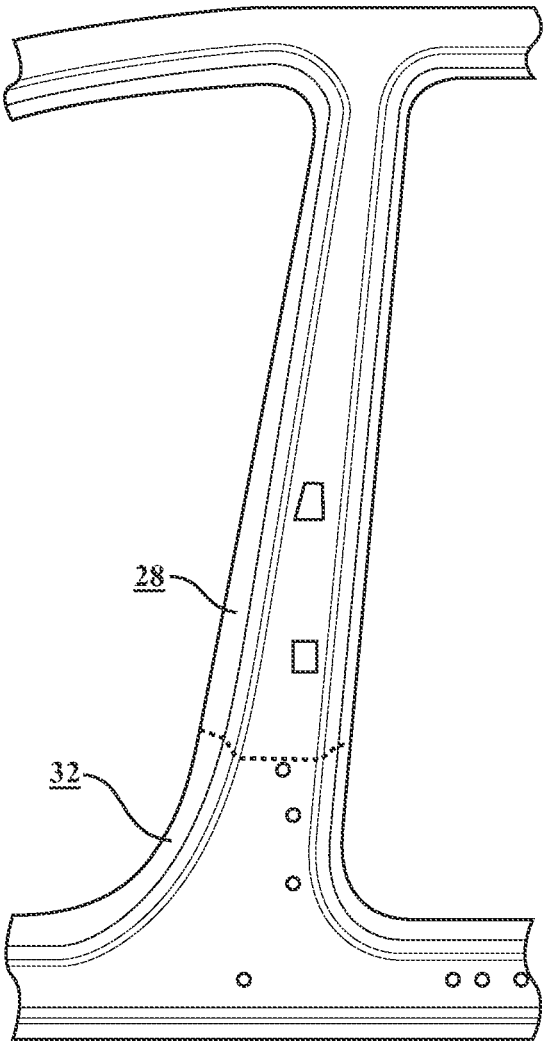
FIG. 5 is an environmental illustration of a pillar such as depicted in FIG. 4 incorporated into a vehicle frame and again depicting both ultra high strength zones, typically at the upper portion of the pillar, in order to minimize intrusion/deformation, in combination with a lower-most located soft zone providing high ductility in order to maximize energy absorption.
Figure 6:
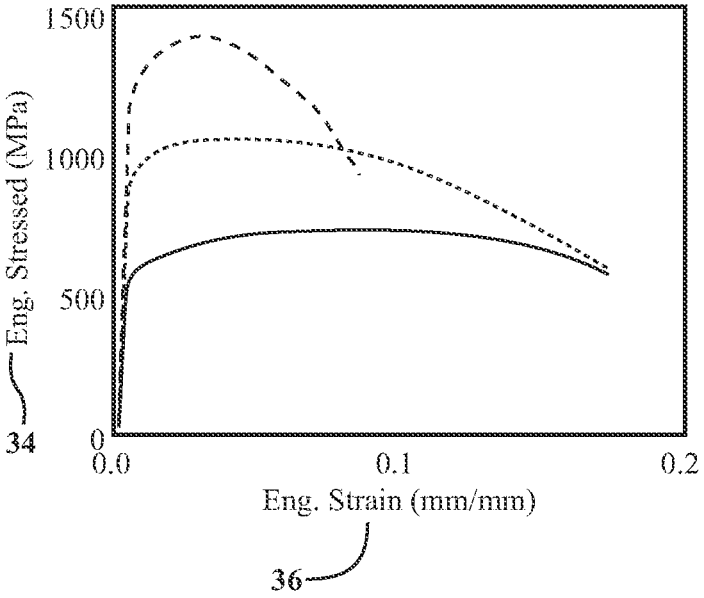
FIG. 6 presents a graphical depiction of stress (in MPa) versus strain (mm/mm) for each of hard, transition and soft zones as shown in a press hardened pillar, as further shown in FIG. 7.
Figure 7:
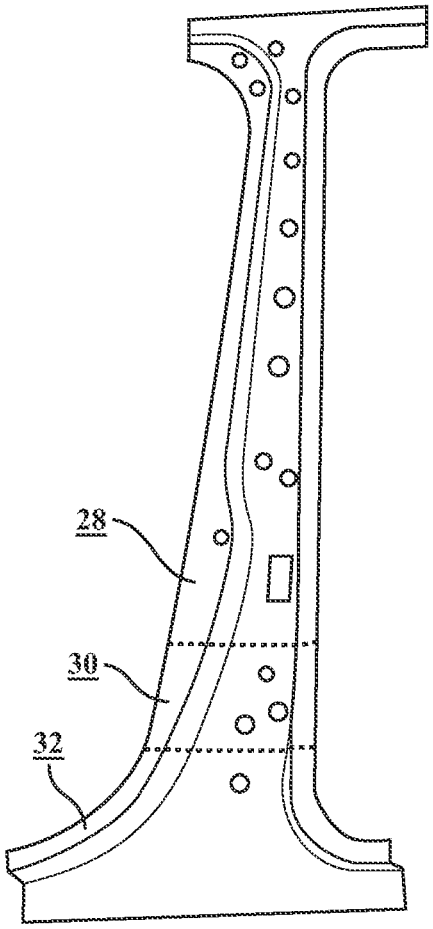

FIG. 4 is an illustration, generally at 26, of a vehicle pillar incorporating each of hard 28 (generally upper end), transition 30 (generally middle) and soft 32 (generally lowermost) zones. As is further reflected in FIG. 5, an environmental illustration of a pillar such as depicted in FIG. 4, is incorporated into a vehicle frame and again depicts both ultra-high strength zones (again at 28) typically at the upper portion of the pillar, in order to minimize intrusion/deformation, in combination with a lower-most located soft zone (again at 32) providing high ductility in order to maximize energy absorption in response to an impact event. FIG. 6 presents a graphical depiction of stress (at 34 in MPa along a vertical axis) versus strain (at 36 in mm/mm along a horizontal axis) of each of hard 28, transition 30 and soft 32 zones, and as shown in FIG. 7.

Figure 8A:
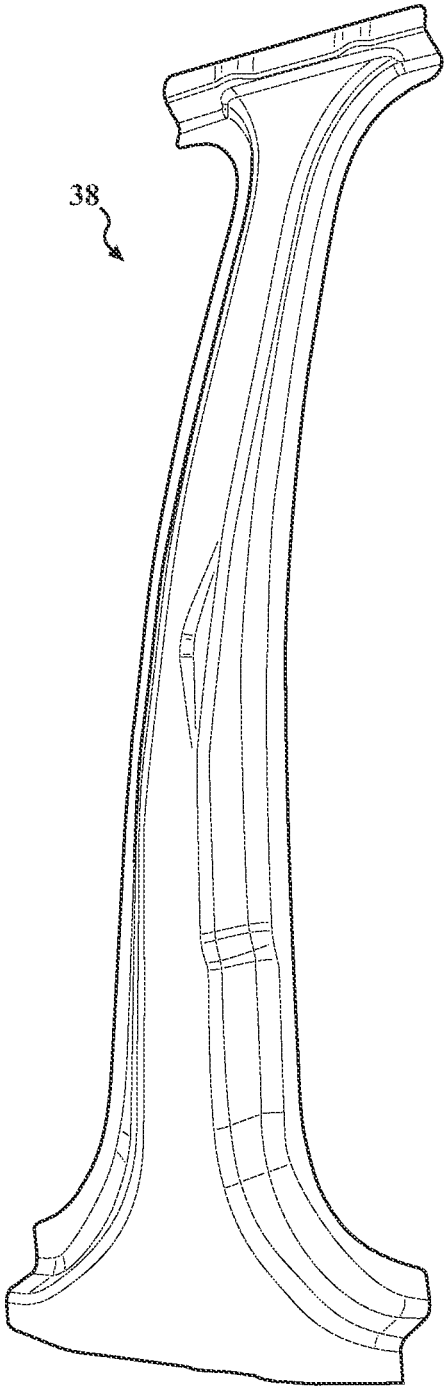
FIGS. 8A and 8B depict a pair of first and second views of a Hybrid Stamped pillar depicting each of the hard and nominal zones.
Figure 8B:
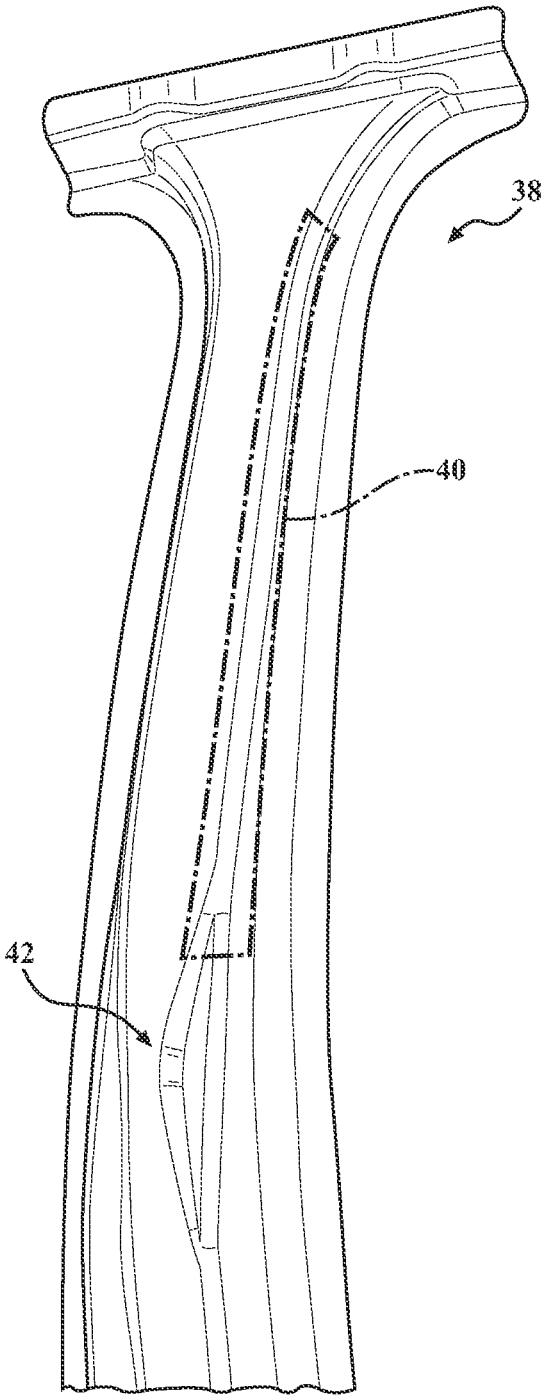

FIGS. 8A and 8B depict a pair of first and second views, each at 38 of a Hybrid Stamped BPlr (B pillar) with Tailor Hardened Zones. That pillar depicts each of hard 40 and nominal 42 zones (FIG. 8B) which is defined in the nominally hard pillar.

Finally, FIG. 9 presents a tabular presentation of each of mean diagonal length, force and hardness (measured in Vickers hardness) comparing the increase in measured quality of each of the un-heated and heated samples. Of note, the sample hardness averaging for a heated sample of 374 HK, as compared to 307 HK for the unheated sample.

Aspects and benefits of the process and assembly include each of the following:

Refined Microstructure—The strategic addition of heat allows for a localized tempered microstructure that enables Advanced High Strength Materials to be stamped with more complex shapes of varied strengths.

Greater Resistance to Localized Necking—The resulting microstructure is more resistant to localized necking.

Higher Strength—The resulting microstructure is of higher hardness and therefore higher strength.

Greater "Draw-Ability"—Strategic heating allows for more complex shapes of greater depth of draw.

Smaller Radii—Smaller radii are possible with the addition of heat in the process.

Greater Resistance to Edge Fractures—The addition of heat allows material properties with greater resistance to edge fractures.

Lower Forming Tonnages—Elevated temperatures during the forming process lowers the forming forces required to form the same shape with a conventionally stamped product.

Higher Production Rates—With the heating elements being in-line with the Blanking and/or Stamping dies, the production rates are lower than oven heating processes.

Higher Quality Less Spring-Back/Less Sidewall Curl—The heating of the material enables the stamping material to have less spring-back and sidewall curl than conventional stamping processes.

Laser Welded Blank—The heating of a laser welded joint allows for the stress relieves that joint, allowing for greater formability during the forming process.

Having described my invention, other and additional preferred embodiments will become apparent to those skilled in the art to which it pertains, and without deviating from the scope of the appended claims. The detailed description and drawings are further understood to be supportive of the disclosure, the scope of which being defined by the claims. While some of the best modes and other embodiments for carrying out the claimed teachings have been described in detail, various alternative designs and embodiments exist for practicing the disclosure defined in the appended claims.

The foregoing disclosure is further understood as not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, a person of ordinary skill in the art will recognize that changes may be made in form and detail without departing from the scope of the present disclosure. Thus, the present disclosure is limited only by the claims.

In the foregoing specification, the disclosure has been described with reference to specific embodiments. However, as one skilled in the art will appreciate, various embodiments disclosed herein can be modified or otherwise implemented in various other ways without departing from the spirit and scope of the disclosure. Accordingly, this description is to be considered as illustrative and is for the purpose of teaching those skilled in the art the manner of making and using various embodiments of the disclosure. It is to be understood that the forms of disclosure herein shown and described are to be taken as representative embodiments. Equivalent elements, materials, processes or steps may be substituted for those representatively illustrated and described herein. Moreover, certain features of the disclosure may be utilized independently of the use of other features, all as would be apparent to one skilled in the art after having the benefit of this description of the disclosure. Expressions such as "including", "comprising", "incorporating", "consisting of", "have", "is" used to describe and claim the present disclosure are intended to be construed in a non-exclusive manner, namely allowing for items, components or elements not explicitly described also to be present. Reference to the singular is also to be construed to relate to the plural.

Further, various embodiments disclosed herein are to be taken in the illustrative and explanatory sense, and should in no way be construed as limiting of the present disclosure. All joinder references (e.g., attached, affixed, coupled, connected, and the like) are only used to aid the reader's understanding of the present disclosure, and may not create limitations, particularly as to the position, orientation, or use of the systems and/or methods disclosed herein. Therefore, joinder references, if any, are to be construed broadly. Moreover, such joinder references do not necessarily infer that two elements are directly connected to each other.

Additionally, all numerical terms, such as, but not limited to, "first", "second", "third", "primary", "secondary", "main" or any other ordinary and/or numerical terms, should also be taken only as identifiers, to assist the reader's understanding of the various elements, embodiments, variations and/or modifications of the present disclosure, and may not create any limitations, particularly as to the order, or preference, of any element, embodiment, variation and/or modification relative to, or over, another element, embodiment, variation and/or modification.

It will also be appreciated that one or more of the elements depicted in the drawings/figures can also be implemented in a more separated or integrated manner, or even removed or rendered as inoperable in certain cases, as is useful in accordance with a particular application. Additionally, any signal hatches in the drawings/figures should be considered only as exemplary, and not limiting, unless otherwise specifically specified.

The invention claimed is:

1. A process for heat treating portions of a steel article, incorporated into a vehicle pillar, or similar structural panel, comprising the steps:

providing a blank steel sheet;

positioning at least one heating element at a location along the blank steel sheet;

heating in a first operation a portion of the blank steel sheet corresponding to the placement of the heating element;

forming the heated blank according to any of a press or stamping operation into a structural part;

repositioning said at least one heating element at a further location of the formed blank; and heating in a second operation a further portion of the structural part to define each of hard, transition and soft deformation zones.

2. The process as described in claim 1, the step of repositioning said at least one heating element further comprising positioning at least one additional heating element at the further portion of the formed blank, not limited to along outer flange locations of the blank, following which a subsequent trimming or final fabricating step is employed to complete the article.

* * * * *